US006663552B1

(12) United States Patent
Yokoyama

(10) Patent No.: US 6,663,552 B1
(45) Date of Patent: Dec. 16, 2003

(54) PACKAGING CONTAINER PRODUCTION METHOD, PACKAGING CONTAINER PRODUCTION APPARATUS, AND PACKAGING MATERIAL

(75) Inventor: Atsuo Yokoyama, Gotemba (JP)

(73) Assignee: Tetra Laval Holdings & Finance, S.A. (CH)

( * ) Notice: Subject to any disclaimer, the term of this patent is extended or adjusted under 35 U.S.C. 154(b) by 0 days.

(21) Appl. No.: 09/451,705

(22) Filed: Dec. 1, 1999

(30) Foreign Application Priority Data

Dec. 7, 1998 (JP) ..... 10-347221

(51) Int. Cl.[7] ..... B31F 7/00

(52) U.S. Cl. ..... 493/441; 493/179; 493/68; 493/182; 493/423

(58) Field of Search ..... 493/68, 69, 71, 493/81, 99, 109, 125, 423, 142, 151, 178, 179, 301, 319, 357, 182, 441; 53/559, 562, 565, 568, 579

(56) References Cited

U.S. PATENT DOCUMENTS 4,091,718 A * 5/1978 Thornhill ..... 493/109
4,257,316 A * 3/1981 Roder et al. ..... 493/68
4,547,183 A * 10/1985 Mowry ..... 493/182
4,624,653 A * 11/1986 McBride et al. ..... 493/127
4,692,132 A * 9/1987 Ikushima et al. ..... 493/109
4,708,708 A * 11/1987 Fries ..... 493/357
4,979,932 A * 12/1990 Burnside ..... 493/179
5,114,392 A * 5/1992 McAdam et al. ..... 493/179
5,833,592 A * 11/1998 Howard et al. ..... 493/301
5,997,459 A * 12/1999 Kruger et al. ..... 493/179

* cited by examiner

*Primary Examiner*—Eugene Kim
*Assistant Examiner*—Sameh H. Tawfik
(74) *Attorney, Agent, or Firm*—Lorusso, Loud & Kelly

(57) ABSTRACT

A packaging container production method includes the steps of: folding a folding allowance formed along one edge of a blank, which is formed from a paper substrate and having a predetermined shape, to thereby form a seal allowance; and superposing the seal allowance and another edge of the blank on each other and longitudinally sealing the resultant overlap portion to thereby form a tubular body. In the folding step, the folding allowance is pressed against a running folding belt to thereby fold the folding allowance. Since the folding belt is used instead of a die in order to fold the folding allowance, even when the thickness, water content, hardness, and other properties of a paper substrate vary among the blanks, the folded state of the folding allowance can be stabilized through adjustment of the position of a pulley. Thus, the quality of packaging containers can be improved.

5 Claims, 6 Drawing Sheets

PACKAGING CONTAINER PRODUCTION METHOD, PACKAGING CONTAINER PRODUCTION APPARATUS, AND PACKAGING MATERIAL

BACKGROUND OF THE INVENTION

1. Field of the Invention

The present invention relates to a packaging container production method, a packaging container production apparatus, and a packaging material, employed to form a packaging container for containing liquid, such as a beverage.

2. Description of the Related Art

Conventionally, when a packaging container for containing liquid, such as a beverage, is to be formed from a packaging material, which, in turn, is formed from a paper substrate, rectangular blanks are blanked from the paper substrate and are then formed into packaging containers by use of a packaging container production apparatus. Specifically, a blank is folded so as to form four panels to thereby form a tubular body of a rectangular cross section, which will become a trunk portion of a packaging container. Next, a filling machine processes one end of the tubular body so as to form the tubular body into a closed-bottomed tubular body. Subsequently, the filling machine fills the closed-bottomed tubular body with liquid and then processes the other end of the tubular body so as to close the other end, thereby yielding a container filled with liquid.

As mentioned above, a blank is folded so as to form four panels to thereby form a tubular body having a rectangular cross section. The blank has a seal allowance formed along one edge thereof. After the blank is folded to form four panels, the seal allowance and the other edge of the blank are superposed on each other, and the resultant overlap portion is sealed longitudinally to thereby form a longitudinal seal portion. Since one of the edges is located within the completed packaging container, the end face thereof is exposed to contained liquid, and thus the paper substrate comes into contact with the liquid. As a result, a certain kind of liquid may penetrate into the paper substrate through the end face, potentially causing leakage of liquid from the container.

To prevent such leakage, a folding allowance is formed along one edge of the blank, and the folding allowance is folded by 180° so as to form a seal allowance. The seal allowance and the other edge of the blank are superposed on each other such that the folding allowance is sandwiched between the seal allowance and the other edge. The resultant overlap portion is sealed longitudinally, thereby yielding a packaging container.

FIG. 1 shows a folding step in a conventional packaging container production method.

As shown in FIG. 1, in the folding step, a folding allowance 102 is formed along one edge of a blank 101. The folding allowance 102 is folded so as to form a seal allowance.

The folding step employs a metallic die 106 having a curved groove 105 formed therein. Passing through the groove 105, the folding allowance 102 is folded by 180° so as to form the seal allowance. Subsequently, the seal allowance and another edge 103 of the blank 101 are superposed on each other. The resultant overlap portion is sealed longitudinally so as to form a longitudinal seal portion, thereby yielding a tubular body 108 having a rectangular cross section. Thus, the end face of the other edge 103 is prevented from coming into contact with liquid, even when a packaging container is formed from the tubular body 108.

Meanwhile, when the thickness, water content, hardness, and other properties of a paper substrate vary among the blanks 101, the folded state of the folding allowance 102 varies among the blanks 101, resulting in quality deterioration of packaging containers. In order to avoid such quality deterioration, the folded state of the folding allowance 102 must be adjusted among the blanks 101. However, since the die 106 is stationary, adjusting the position thereof or modifying the shape of the groove 105 is difficult to perform.

In the folding step, the folding allowance 102 is brought into contact with the die 106 while passing through the groove 105 at a speed of 300–600 m/min. Accordingly, a large amount of paper dust is generated and contaminates the environment around the packaging container production apparatus. Also, adhering to the blank 101, paper dust may be taken into the packaging container.

Since heat is generated through contact of the die 106 with the folding allowance 102 moving at high speed, the blank 101 must be cooled. Thus, a water (or air) cooling apparatus must be employed, resulting in an increase in cost of the packaging container production apparatus.

SUMMARY OF THE INVENTION

An object of the present invention is to solve the above-mentioned problems in the conventional packaging container production apparatus and to provide a packaging container production method and apparatus which do not require a die and therefore can reduce cost and which can suppress generation of paper dust to thereby improve the quality of packaging containers. Another object of the present invention is to provide a packaging material which can be used in the packaging container production method and apparatus.

To achieve the above object, the present invention provides a packaging container production method comprising the steps of: providing a blank formed from a paper substrate and having a predetermined shape; folding a folding allowance formed along one edge of the blank to thereby form a seal allowance; and superposing the seal allowance and another edge of the blank on each other and longitudinally sealing the resultant overlap portion to thereby form a tubular body.

In the folding step, the folding allowance is pressed against a running folding belt to thereby fold the folding allowance.

Since the folding belt is used instead of a die in order to fold the folding allowance, even when the thickness, water content, hardness, and other properties of a paper substrate vary among the blanks, the folded state of the folding allowance can be stabilized through adjustment of the position of a pulley. Thus, the quality of packaging containers can be improved.

In the folding step, one side of the folding allowance is in contact with the folding belt, but friction generated therebetween is very weak because of a small difference in traveling speed between blanks and the folding belt. Further, the movement of one side of the folding allowance is restricted by the folding belt, whereas the other side of the folding allowance is not in contact with the folding belt and is thus free. Thus, the resistance of the folding belt to the travel of blanks is low, whereby the generation of paper dust is suppressed to thereby improve environmental conditions around the packaging container production apparatus. Also, entry of paper dust into a packaging container, which would otherwise result from adhesion of paper dust to a blank, can be prevented.

Since the contact between blanks and the folding belt does not involve heat generation, an apparatus for cooling the blanks is not required, thereby reducing the cost of the packaging container production apparatus.

Preferably, the seal allowance and the other edge of the blank are superposed on each other such that the folding allowance abuts the other edge.

The present invention further provides a packaging container production apparatus comprising: conveying means for conveying a blank formed from a paper substrate and having a predetermined shape while holding the blank except at one edge; folding means for folding a folding allowance formed along the one edge of the blank being conveyed to thereby form a seal allowance; and sealing means for superposing the seal allowance and another edge of the blank on each other and longitudinally sealing the resultant overlap portion.

The folding means comprises a folding belt traveling in parallel with the conveying means and disposed such that the angle of inclination thereof increases with the movement of the blank.

Preferably, the seal allowance and the other edge of the blank are superposed on each other such that the folding allowance abuts the other edge, whereby the end face of the other edge does not come into contact with liquid contained in a completed packaging container.

The present invention still further provides a packaging material comprising a paper substrate. A blank having a predetermined shape is formed from the paper substrate. A folding allowance formed along one edge of the blank is folded through pressing to thereby form a seal allowance. The seal allowance and another edge of the blank are superposed on each other, and the resultant overlap portion is sealed longitudinally to thereby form the blank into a tubular body.

BRIEF DESCRIPTION OF THE DRAWINGS

The structure and features of the packaging container production method, packaging container production apparatus, and packaging material according to the present invention will be readily appreciated as the same becomes better understood by referring to the drawings, in which.

DESCRIPTION OF THE PREFERRED EMBODIMENTS

Embodiments of the present invention will next be described in detail with reference to the drawings.

Figure 1:
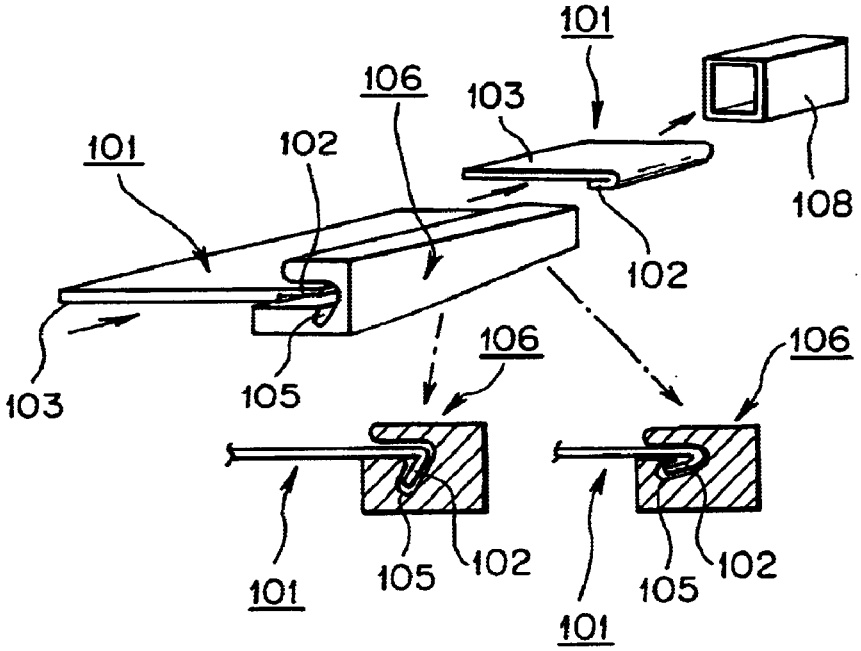
FIG. 1 PRIOR ART
FIG. 1 is a view showing a folding step in a conventional packaging container production method.
Figure 2:
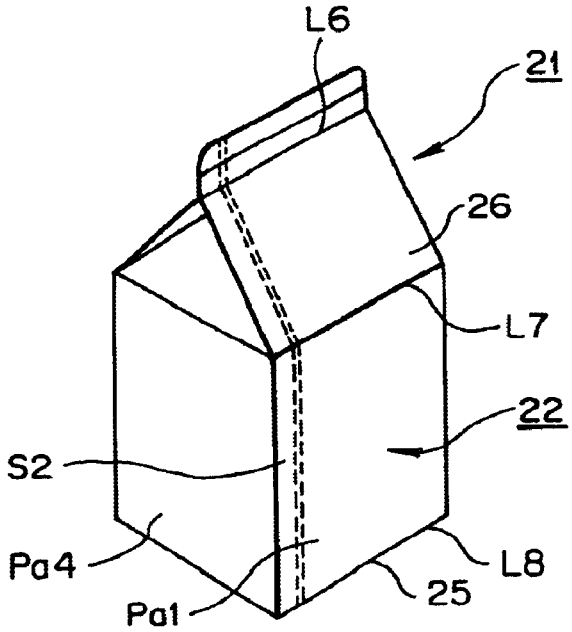
FIG. 2 is a perspective view of a packaging container according to a first embodiment of the present invention.
Figure 3:
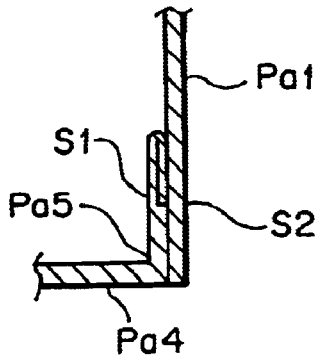
FIG. 3 is a sectional view of an essential portion of the packaging container of FIG. 2.
Figure 4:
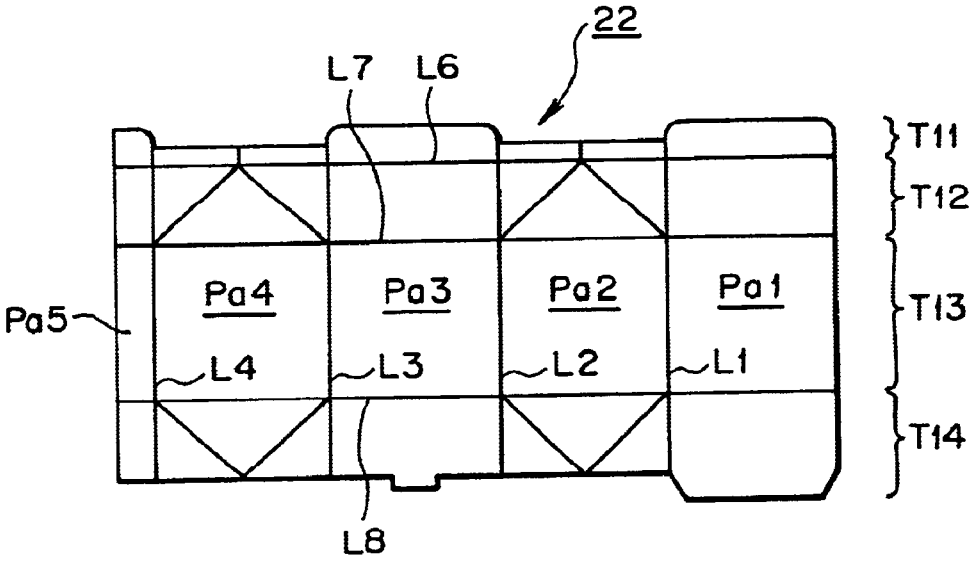
FIG. 4 is a development view showing a blank to be folded into the packaging container of FIG. 2.
Figure 5:
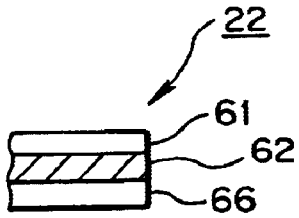
FIG. 5 is a sectional view showing a first example of the structure of the blank of FIG. 4.
Figure 6:
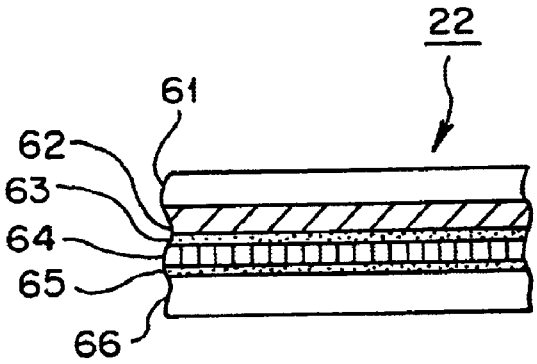
FIG. 6 is a sectional view showing a second example of the structure of the blank of FIG. 4.
Figure 7:
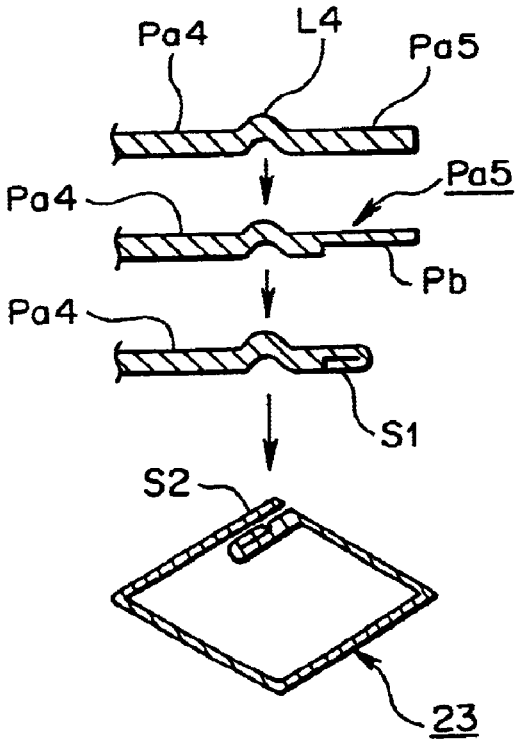
FIG. 7 is a view showing the steps of forming a tubular body of the packaging container of FIG. 2.

FIG. 2 is a perspective view of a packaging container according to a first embodiment of the present invention; FIG. 3 is a sectional view of an essential portion of the packaging container of FIG. 2; FIG. 4 is a development view showing a blank to be folded into the packaging container of FIG. 2; FIG. 5 is a sectional view showing a first example of the structure of the blank of FIG. 4; FIG. 6 is a sectional view showing a second example of the structure of the blank of FIG. 4; and FIG. 7 is a view showing the steps of forming a tubular body of the packaging container of FIG. 2.

In FIGS. 2 to 7, reference numeral 21 denotes a packaging container for containing liquid, such as drink. The packaging container 21 is formed from a blank 22, which is treated to prevent liquid leakage and is mainly formed from a paper substrate. As shown in FIG. 5 or 6, the blank 22 has a laminated structure. The blank 22 shown in FIG. 5 includes an outer layer 61, a paper substrate 62, and an inner layer 66. The blank 22 shown in FIG. 6 includes an outer layer 61, a paper substrate 62, an adhesive layer 63, a barrier layer 64, an adhesive layer 65, and an inner layer 66.

In general, the outer layer 61, the adhesive layers 63 and 65, and the inner layer 66 are formed from resin, such as polyethylene or ethylene copolymer. The outer layer 61 and the inner layer 66 is preferably formed from low-density polyethylene. The barrier layer 64 is formed from, for example, aluminum foil. The outer surface of the outer layer 61 or that of the paper substrate 62 is subjected to printing as needed.

A method of producing the packaging container 21 will next be described.

As shown in FIG. 4, the blank 22 is blanked from a paper substrate into a rectangular plate-like shape, and has creases L1 to L4 formed vertically to thereby define a first panel Pa1, a second panel Pa2, a third panel Pa3, a fourth panel Pa4, and a fifth panel Pa5. The blank 22 also has creases L6 to L8 formed horizontally in FIG. 4 to thereby define a top seal portion T11, an upper panel portion T12, a middle panel portion T13, and a lower panel portion T14. As shown in FIG. 7, one edge of the blank 22; i.e., the edge of the fifth panel Pa5 is scraped so as to form a folding allowance Pb, which is thinner than the remaining portion of the fifth panel Pa5. The folding allowance Pb is folded by 180° to thereby form a seal allowance S1.

The seal allowance S1 is superposed on another edge of the blank 22; i.e., on the edge of the first panel Pa1 such that the folding allowance Pb abuts the first panel Pa1. The resultant overlap portion is sealed longitudinally through thermo-compression, thereby forming a longitudinal seal portion S2. Thus, a tubular body 23 having a rectangular cross section is formed. When the tubular body 23 is formed into the packaging container 21, the end face of the fifth panel Pa5 is not in contact with contained liquid.

In a filling machine, the tubular body 23 undergoes folding and sealing along the crease L8, whereby a bottom portion 25 is formed by means of the lower panel portion T14, thereby forming a closed-bottomed tubular body. Subsequently, the closed-bottomed tubular body is filled with liquid and then undergoes folding and sealing along the creases L6 and L7, whereby a top portion 26 is formed by means of the top seal portion T11 and the upper panel portion T12, thereby completing the packaging container 21.

Next, the step of folding the folding allowance Pb so as to form the seal allowance S1 will be described.

Figure 8:
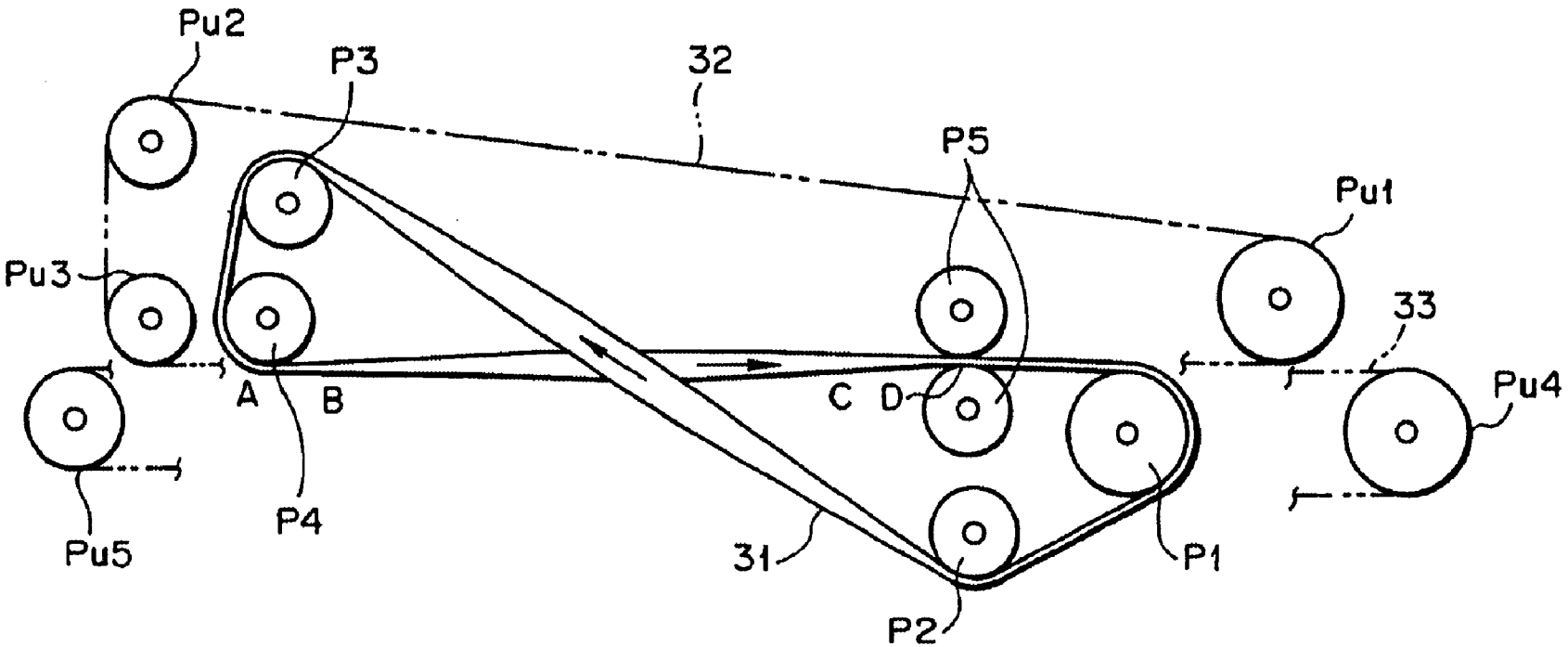
FIG. 8 is a view showing a packaging container production apparatus according to the first embodiment.
Figure 9:
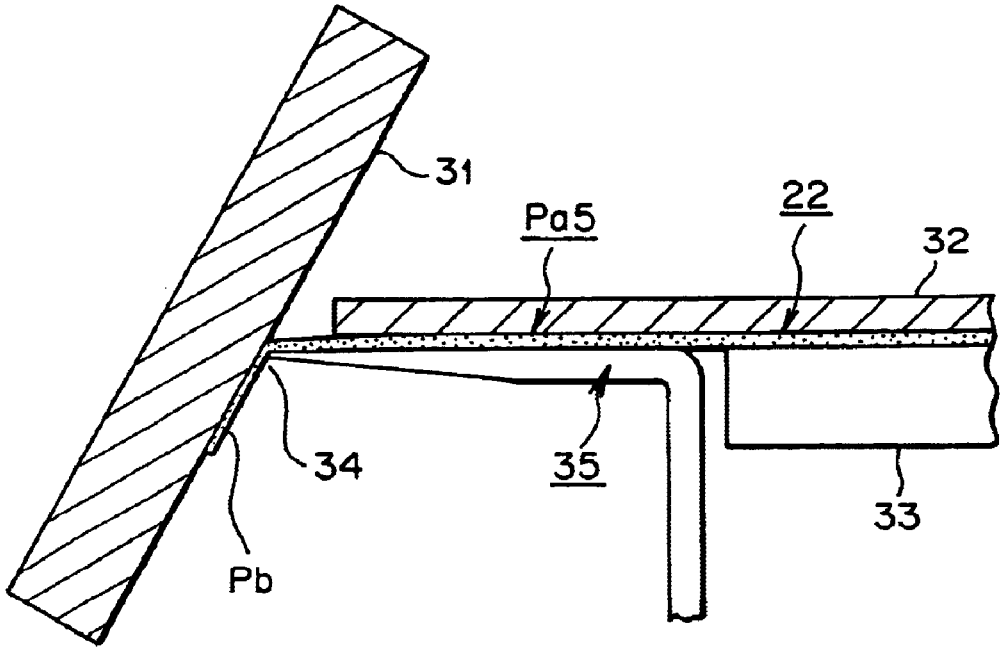
FIG. 9 is a first view showing a folding step in the first embodiment.

FIG. 8 is a view showing a packaging container production apparatus according to the first embodiment; FIG. 9 is a first view showing a folding step in the first embodiment; and FIG. 10 is a second view showing the folding step in the first embodiment.

Figure 10:
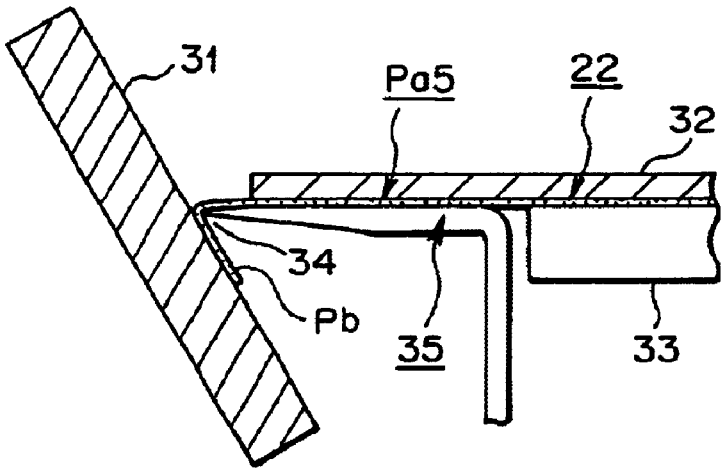
FIG. 10 is a second view showing the folding step in the first embodiment.

As shown in FIGS. 8–10, an endless folding belt 31 serving as the folding means is extended between and wound around pulleys P1 to P5. Rotation effected through operation of unillustrated driving means is transmitted to the driving pulley P1 to thereby run the folding belt 31. Traveling between the pulley P2 and P3, the folding belt 31 is twisted by 180° while being guided by an unillustrated plurality of pulleys. Then, traveling between the pulleys P4 and P5, the folding belt 31 is twisted by 180° while being guided by an unillustrated plurality of pulleys, in the reverse direction of travel between the pulleys P2 and P3. Through this twisted travel, the folding belt 31 can travel without self interference. Material for the folding belt 31 is not particularly limited. The folding belt 31 may be made of any material, such as rubber or chemical fiber. The cross section of the folding belt 31 has a flat rectangular shape, but may be modified as needed.

An endless, upper press belt 32 is extended between and wound around pulleys Pu1 to Pu3. Rotation effected through operation of the above-mentioned driving means is transmitted to the driving pulley Pu1 to thereby run the upper press belt 32. An endless, lower guide belt 33 is extended between and wound around pulleys Pu4 and Pu5. Rotation effected through operation of the above-mentioned driving means is transmitted to the driving pulley Pu4 to thereby run the lower guide belt 33. The folding belt 31, the upper press belt 32, and the lower guide belt 33 constitute a folding apparatus.

When the folding allowance Pb is to be folded, the blank 22 is conveyed in such a manner that a portion of the blank 22 excluding the fifth panel Pa5 is held between the upper press belt 32 and the lower guide belt 33. The folding belt 31 travels in parallel with and synchronously with the upper press belt 32 and the lower guide belt 33. Accordingly, the step of folding the folding allowance Pb can be performed stably. The upper press belt 32 and the lower guide belt 33 constitute the conveying means.

While the folding belt 31 travels from the pulley P4 to the pulleys P5, the inclination angle of the surface of the folding belt 31 abutting the folding allowance Pb varies from 0° to 180°. Accordingly, the folding angle of the folding allowance Pb is initially 0° at position A, and increases to 45° at position B, 120° at position C, and 180° at position D. The folding allowance Pb is stably folded along a folding edge 34 of a folding base 35 to thereby become the seal allowance S1 (FIG. 7). FIG. 9 shows the state of the folding allowance Pb as viewed at position B, and FIG. 10 shows the state of the folding allowance Pb as viewed at position C.

Since a pair of upper and lower press rollers serves as the pulleys P5, the folding allowance Pb is reliably pressed at position D, thereby preventing springback of the folded folding allowance Pb.

In a sealing step subsequent to the above-described folding step, the seal allowance S1 and the first panel Pa1 (FIG. 3) are superposed on each other in such a manner that the folding allowance Pb abuts the first panel Pa1. The resultant overlap portion is sealed longitudinally through thermocompression. An unillustrated sealing apparatus serving as the sealing means is disposed downstream of the folding apparatus with respect to the conveying direction of the blank 22. The sealing apparatus may employ, for example, resistance heating, induction heating, or ultrasonic sealing, in order to perform sealing.

As described above, the step of folding the folding allowance Pb employs the folding belt 31 instead of a die. Therefore, even when the thickness, water content, hardness, and other properties of the paper substrate 62 (FIGS. 5 and 6) vary among the blanks 22, the folded state of the folding allowance Pb can be stabilized through adjustment of the position of the pulleys P1 to P5. Thus, the quality of the packaging containers 21 (FIG. 2) can be improved.

In the folding step, one side of the folding allowance Pb is in contact with the folding belt 31, but friction generated therebetween is very weak, since the folding belt 31 travels synchronously with the upper press belt 32 and the lower guide belt 33 with a resultant small difference in traveling speed between the blanks 22 and the folding belt 31. Further, the movement of one side of the folding allowance Pb is restricted by the folding belt 31, whereas the other side of the folding allowance Pb is not in contact with the folding belt 31 and is thus free. Thus, the resistance of the folding belt 31 to the travel of the blanks 22 is low, whereby the generation of paper dust is suppressed to thereby improve environmental conditions around the packaging container production apparatus for producing the packaging containers 21. Also, entry of paper dust into the packaging container 21, which would otherwise result from adhesion of paper dust to the blank 22, can be prevented.

Since the contact between blanks 22 and the folding belt 31 does not involve heat generation, an apparatus for cooling the blanks 22 is not required, thereby reducing the cost of the packaging container production apparatus for producing the packaging containers 21.

Next, a second embodiment of the present invention will be described. The same features as those of the first embodiment are denoted by common reference numerals, and their description is omitted.

Figure 11:
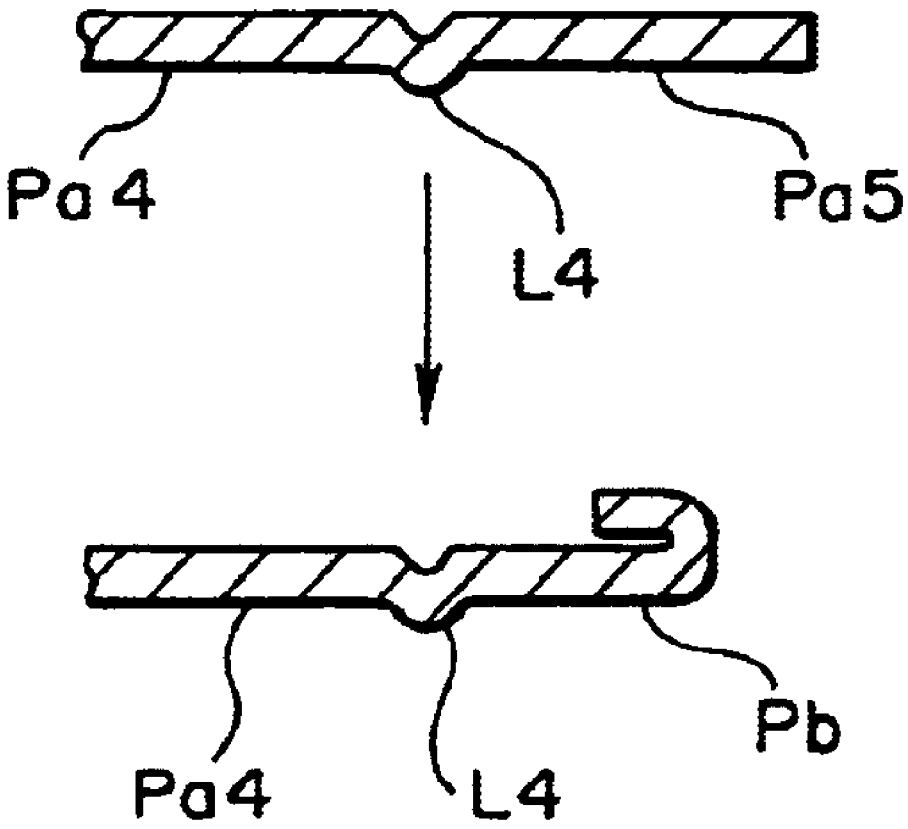
FIG. 11 is a view showing a step of folding a folding allowance in a second embodiment of the present invention.

FIG. 11 is a view showing a step of folding a folding allowance in a second embodiment of the present invention.

As shown in FIG. 11, the folding allowance Pb of the fifth panel Pa5 is not scraped, but has the same thickness as that of the rest of the blank 22. Even when this type of the blank 22 (FIG. 4) is used, the folding allowance Pb can be folded reliably in the folding step.

The present invention is not limited to the above-described embodiments. Numerous modifications and variations of the present invention are possible in light of the spirit of the present invention, and they are not excluded from the scope of the present invention.

What is claimed is:

1. A packaging container production apparatus comprising:

(a) conveying means for defining a path of movement and for conveying along said path of movement a blank formed from a paper substrate and having a predetermined shape while holding the blank except at one edge;

(b) folding means for folding a folding allowance formed along the one edge of the blank being conveyed to thereby form a seal allowance; and (c) sealing means for superposing the seal allowance and another edge of the blank on each other to form an overlap portion and longitudinally sealing the overlap portion, wherein (d) said folding means comprises a folding belt traveling in parallel with said conveying means and having an angle of inclination which increases along the path of movement of the blank, said folding belt having a run with a twist and positioned to contact said one edge over the length of said run.

2. A packaging container production apparatus according to claim 1, wherein the seal allowance and the other edge of the blank are superposed on each other such that the folding allowance abuts the other edge, whereby the end face of the other edge does not come into contact with liquid contained in a completed packaging container.

3. A packaging container production apparatus comprising:

a conveyor presenting a blank support surface for conveying a container blank in a conveyance direction with the one edge of the blank extending transversely of said conveyance direction beyond said blank support surface;

a folding base presenting an edge support surface, transversely spaced from the blank support surface, for supporting the one edge and presenting a folding edge oriented in said conveyance direction and positioned to be spaced from the one edge of the blank by a distance defining a folding allowance;

an endless folding belt having a run with a 180° twist pressing against said folding edge with the one edge therebetween, whereby the folding allowance is folded first down and then under the folding base as the container blank is conveyed in the conveyance direction; and a sealer for sealing the folding allowance against an adjacent portion of the container blank and against an opposing edge of the container blank, thereby forming the blank into a tubular configuration.

4. A packaging container production apparatus according to claim 3 wherein said conveyor is a first endless belt and wherein said apparatus further comprises a second endless belt having a lower run superimposed on the blank support surface of said first endless belt, whereby the container blank undergoing conveyance in the conveyance direction is held between said blank support surface and a lower run of said second endless belt.

5. A packaging container production apparatus according to claim 4 wherein said second endless belt is wider than said first endless belt with an edge portion extending onto and supported by said folding base.

* * * * *